US005785089A

United States Patent [19]

Kuykendal et al.

[11] Patent Number: 5,785,089

[45] Date of Patent: Jul. 28, 1998

[54] FLUID FLOW NOZZLE ASSEMBLY AND METHOD

[76] Inventors: Robert L. Kuykendal; Ronald S. Deichmann, both of 1136 Washington, St. Louis, Mo. 63101

[21] Appl. No.: 803,579

[22] Filed: Feb. 21, 1997

Related U.S. Application Data

[62] Division of Ser. No. 488,968, Jun. 8, 1995, Pat. No. 5,641,120.

[51] Int. Cl.[6] ..... F21P 7/00

[52] U.S. Cl. ..... 138/42

[58] Field of Search ..... 234/18, 590, 553; 138/42; 417/539, 540

[56] References Cited

U.S. PATENT DOCUMENTS

| | | | |
|---|---|---|---|
| 1,952,994 | 3/1934 | Laird | 417/540 X |
| 2,210,480 | 8/1940 | Brice | 138/42 |
| 4,326,554 | 4/1982 | Gongwer | 138/42 X |
| 4,585,400 | 4/1986 | Miller | 417/540 |
| 4,634,347 | 1/1987 | Gauffin et al. | 417/540 X |

FOREIGN PATENT DOCUMENTS

| | | | |
|---|---|---|---|
| 662413 | 4/1934 | Germany | 138/42 |
| 2824604 | 12/1979 | Germany | 417/540 |

*Primary Examiner*—Kevin Weldon
*Attorney, Agent, or Firm*—Henry W. Cummings

[57] ABSTRACT

In accordance with one embodiment of the present invention, liquid material enters circumferencially into a generally cylindrical outer walled cylinder. A baffle may be provided to facilitate circumferencial flow. The tangential, circumferencial flow tends to reduce turbulence. In the outer chamber a top wall is provided and a cushion of air is located between the top wall and the top of the liquid medium to effect cushioning. After circumferencial flow, the liquid flows radially inwardly into an inner fluid chamber through a plurality of openings in an inner cylindrical wall. Within the inner chamber and spaced between the bottom wall and the top wall is a diffuser section. The diffuser section provides a large plurality of parallel fluid flow paths to dampen remaining major currents by lowering the fluid velocity and thus the Reynolds number. The upper surface is arcuate. Thus fluid flows radially upwardly and inwardly to a knife-edged type orifice which results in laminar fluid flow exiting therefrom. In a preferred embodiment, a light source is located within the inner chamber and is offset from the center line of the inner chamber. Focusing means are also provided in the inner chamber to direct the light path so as to align the light path with the orifice so that the light follows the laminar fluid flow. In accordance with another embodiment of the present invention the inlet to the outer chamber includes a double walled bladder-like hose wherein fluid is made to flow in a parallel manner first forwardly within the tube and then backwardly within the tube and then again forwardly to further dampen and isolate the system from pressure variations including pump noise.

4 Claims, 5 Drawing Sheets

10
10

144
142
146

159
15
15
150
158
144
140
142
146

156
135a 139
137
152
154
134a
134

13
13
135

FLUID FLOW NOZZLE ASSEMBLY AND METHOD

This application is a division of application Ser. No. 08/488,968, filed Jun. 8, 1995 now U.S. Pat. No. 5,641,120.

FIELD OF THE INVENTION

This invention relates to fluid flow devices, particularly of that class of fluid flow nozzles with laminar discharge, and further to the field of illuminated fluid nozzles.

BACKGROUND OF THE INVENTION

In U.S. Pat. No. 5,160,086 granted on Nov. 3, 1992, a laminar flow fluid nozzle is provided for use in decorative water fountains, and also for industrial applications. Initial fluid flow is provided through a double-walled, bladder like fluid supply hose (32).

The inflated double hose isolates fluid flow from the pump and other vibrations which would otherwise be transmitted by means of a rigid hose. Furthmore, the double hose functions to absorb or accumulate small pressure variations known as "pump noise" which are usually present in the input stream.

The fluid next flows into a fluid chamber over a baffle (22). Inside pockets of air (18) cushion remaining pressure variations of the fluid stream.

Fluid next flows through a diffuser (20) which provides a plurality of parallel fluid baths to dampen remaining major currents by lowering the fluid velocity, and thus the Reynolds number to obtain laminar fluid flow.

A knife edged orifice (12) results in a narrow fluid stream (14). However, orifice (12) may be offset with respect to the center of enclosure (11).

A light transmitting means (24) is aligned with orifice (12) by focusing means (28.

A spring system (30) may be provided to absorb ambient vibrations.

OBJECTS OF THE INVENTION

1. One object of the present invention is to provide an improved dampening system in the fluid supply hose.
2. Another object of the present invention is to provide an improved pattern of fluid flow within the supply hose.
3. Another object of the present invention is to provide an arrangement for improved fluid flow in the outer fluid chamber.
4. Another object of the present invention is to provide improved fluid flow into the inner fluid chamber.
5. Another object of the present invention is to provide an improved fluid flow pattern from the diffuser means to the orifice.
6. Other objects will be apparent from the following description and drawings.

THE DRAWINGS

SUMMARY OF THE INVENTION

Figure 2:
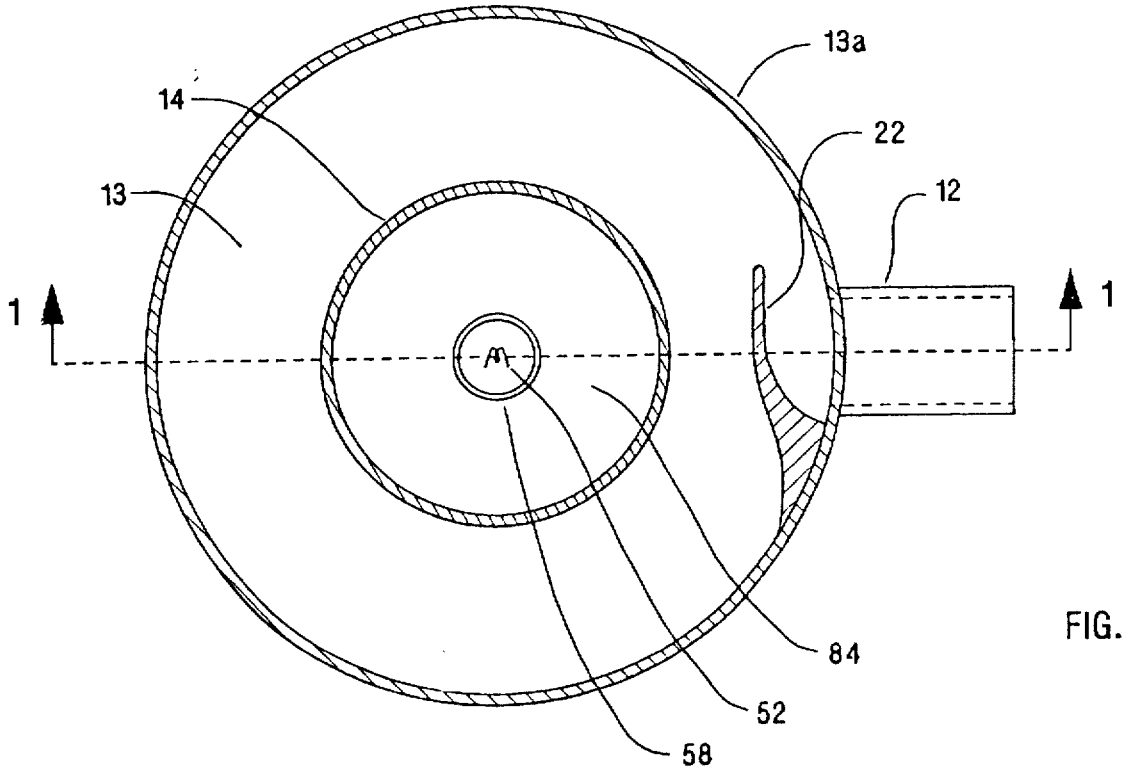
FIG. 2 is a plan view looking in the direction of the arrows along the line 2—2 in FIG. 1.
Figure 1:
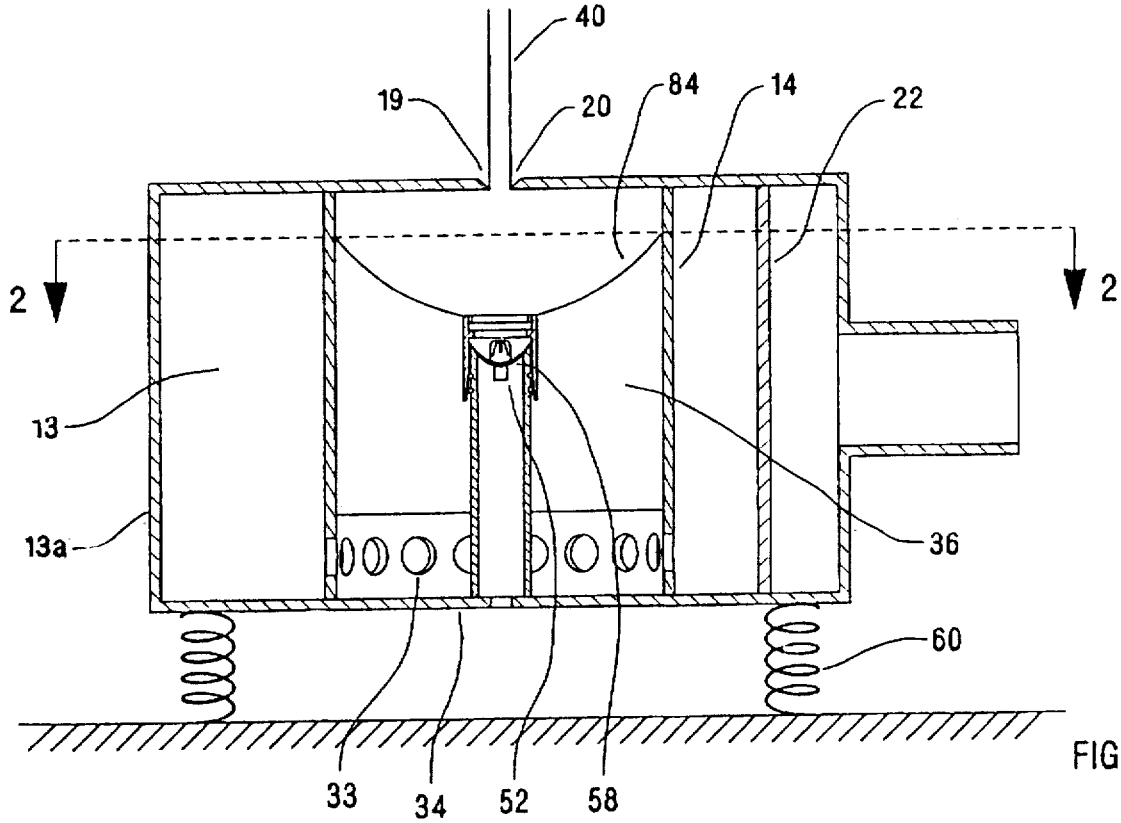
FIG. 1 is a vertical sectional view of the nozzle assembly of the present invention looking in the direction of the arrows along the line 1—1 in FIG. 2.

In accordance with one embodiment of the present invention, liquid material enters circumferencially into a generally cylindrical outer walled chamber. A baffle may be provided to facilitate circumferencial flow. The tangential, circumferencial flow tends to reduce turbulence. In the outer chamber a top wall is provided and a cushion of air is located between the top wall and the top of the liquid medium to effect cushioning. After circumferencial flow, the liquid flows radially inwardly into an inner fluid chamber through a plurality of openings in an inner cylindrical wall. Within the inner chamber and spaced between the bottom wall and the top wall is a diffuser section. The diffuser section provides a large plurality of parallel fluid flow paths to dampen remaining major currents by lowering the fluid velocity and thus the Reynolds number. The upper surface is arcuate. Thus fluid flows radially upwardly and inwardly to a knife-edged type orifice which results in laminar fluid flow exiting therefrom. In a preferred embodiment, a light source is located within the inner chamber and is offset from the center line of the inner chamber. Focusing means are also provided in the inner chamber to direct the light path so as to align the light path with the orifice so that the light follows the laminar fluid flow. In accordance with another embodiment of the present invention the inlet to the outer chamber includes a double walled bladder-like hose wherein fluid is made to flow in a parallel manner first forwardly within the tube and then backwardly within the tube and then again forwardly to further dampen and isolate the system from pressure variations including pump noise.

DESCRIPTION OF PREFERRED EMBODIMENTS

Liquid enters through inlet (12) into a generally cylindrical outer chamber (13) including a cylindrical wall (13A).

The outer chamber is defined by the outer cylindrical wall (13A) and an inner cylindrical wall (14), a generally circular top member (18) having an opening for an orifice (19) and a bottom wall (34).

The liquid occupies only a portion of the chamber (13), the upper portion of the chamber is occupied by air as indicated at (24) which provides a cushioning effect on the liquid.

The liquid travels tangentially and circumferentially within the chamber (13) and then flows into an inner chamber (33) through a plurality of openings (30) in the inner cylindrical wall (14).

In the mid portion of the inner chamber (33) is located a diffuser material (36). Diffuser material (36) may be combination of open mesh screens, open cell foam material, a parallel tube assembly or other diffusing means.

The diffuser means provides a very large plurality of parallel fluid paths to dampen all remaining or essentially all remaining major currents by lowering the fluid velocity and thus the Reynolds number.

The top portion (37) of the diffuser is preferably arcuate in shape whereby after the fluid exits from the diffuser the fluid flows radially inwardly toward the opening (19) where the orifice (20) is located. Preferably the orifice (20) is a knife edge orifice.

In one embodiment the opening (19) and orifice (20) are located a distance spaced from the center line of the inner chamber (33), about ⅛th to ¼th of the diameter of the inner chamber.

As the flow exits from the knife-edged orifice (20) fluid flow (40) is essential laminar in character.

Located in the lower portion of the chamber (33) is a light source (52) and a focusing assembly (58). The focusing assembly (58) focuses light eminating from the source (52) such that it is aligned with the orifice (20) and the light flows within the laminar stream (40).

It has been found that the tangential entry and circumferencial flow in chamber (13) is effective to materially reduce turbulence.

At the same time the air in the air chamber (24) provides effective cushioning.

The arcuate top shape of the diffuser is effective to result in more uniform fluid flow from the diffuser into the orifice (20) and thus make a more laminar flow from the orifice (20).

A spring system (60) comprising one or more springs, for example a generally cylindrical coil spring may also be provided to reduce or dampen ambient vibration, as described in greater detail in U.S. Pat. No. 5,160,086, hereby incorporated into this Description by this reference.

Figure 3:
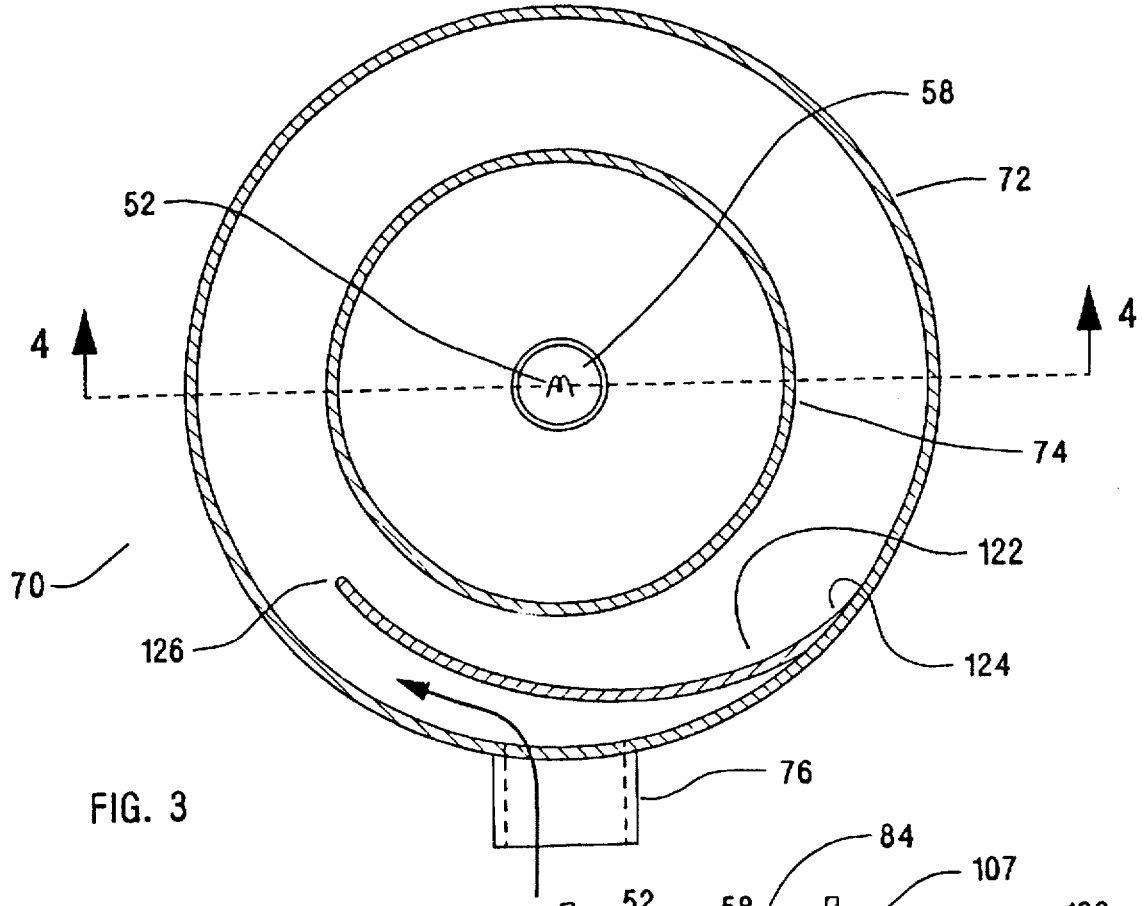
FIG. 3 is a plan view of another embodiment of the present invention.
Figure 4:
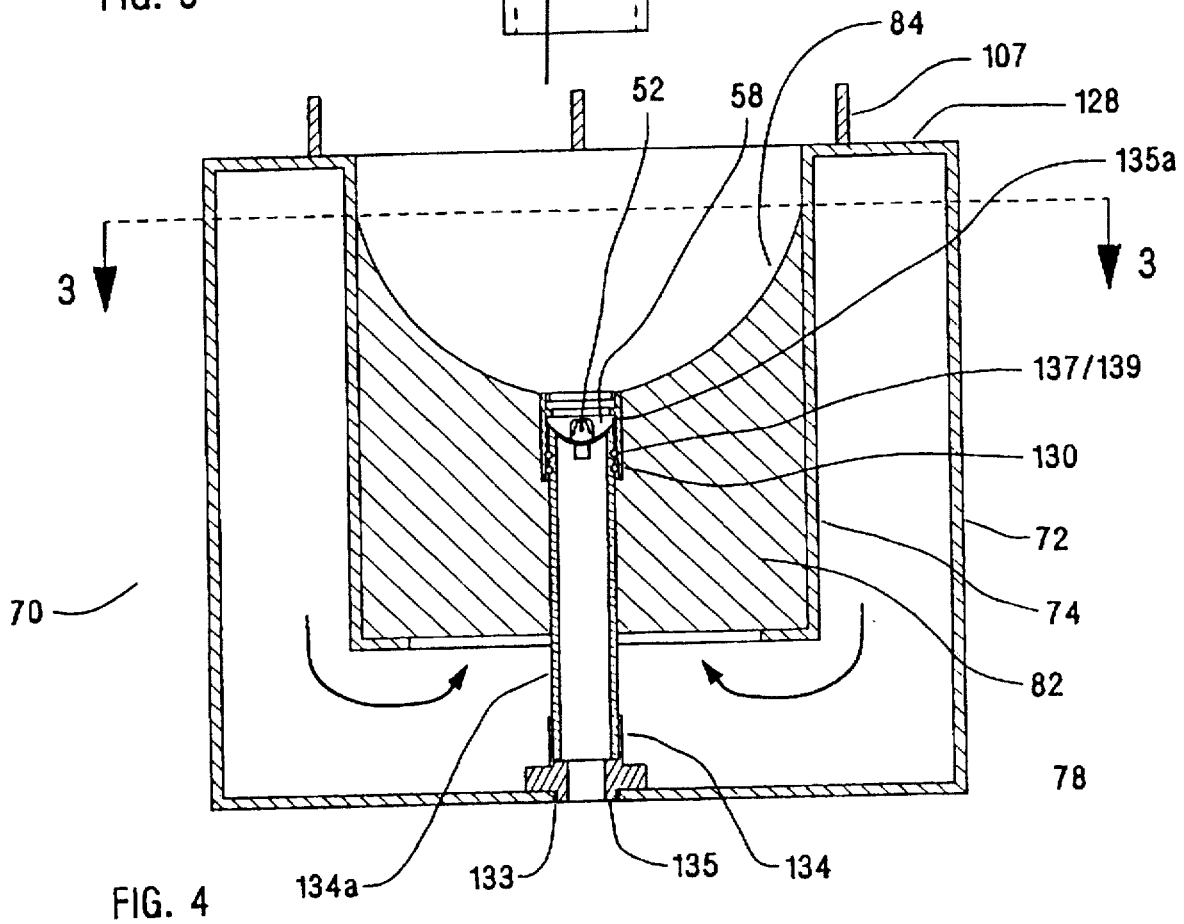
FIG. 4 is a side elevation view of the embodiment shown in FIG. 3 looking in the direction of the arrows along the line 4—4 in FIG. 3.
Figure 8:
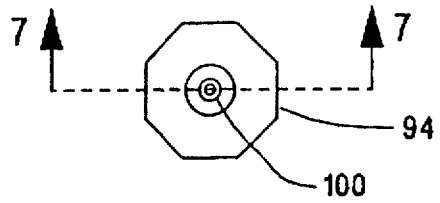
FIG. 8 is a plan view of the orifice assembly illustrated in FIG. 7 looking in the direction of the arrows along the line 8—8 in FIG. 7.
Figure 7:
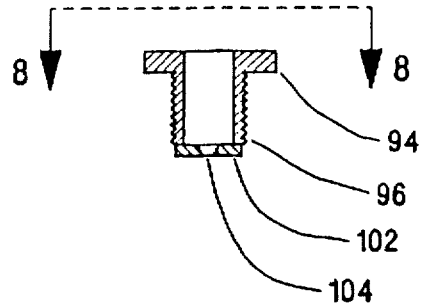
FIG. 7 is a view of the orifice assembly of the present invention.
Figure 9:
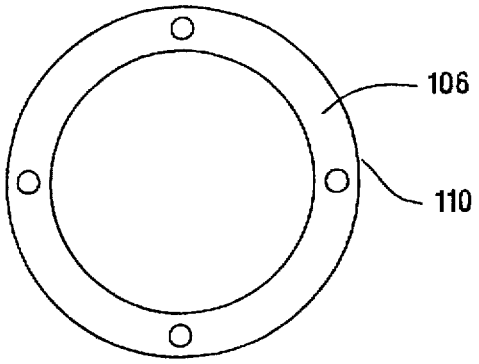
FIG. 9 is a view of a gasket to be utilized in accordance with the present invention.

Another embodiment of the present invention is illustrated in FIGS. 3 and 4. In this embodiment indicated generally at 70 an outer wall, cylindrical in shape 72, is provided. Located radially inwardly from outer walls 72 is an inner wall 74. Inner wall 74 extends downwardly and is open at the bottom as indicated at 78. A partial top plate 128 and a bottom plate 132 are also provided.

An inlet 76 is connected to the outer wall 72 so that fluid flows inwardly at 76.

An arcuate baffle 122 which is connected to outer wall 72 at 124 is provided. Baffle 122 extends arcuately adjacent to wall 72 and terminates at a point 126, leaving a space for fluid flow 127. Fluid flows downwardly and circumferentially around outer wall 72 into chamber 80 located below opening 78, then tangentially inward and upward through opening 78.

A diffuser 82 similar to diffuser 36 and to diffuser 20 in U.S. Pat. No. 5,160,086 is provided.

However, the upper surface of diffuser 82 is arcuate as indicated at 84.

Figure 5:
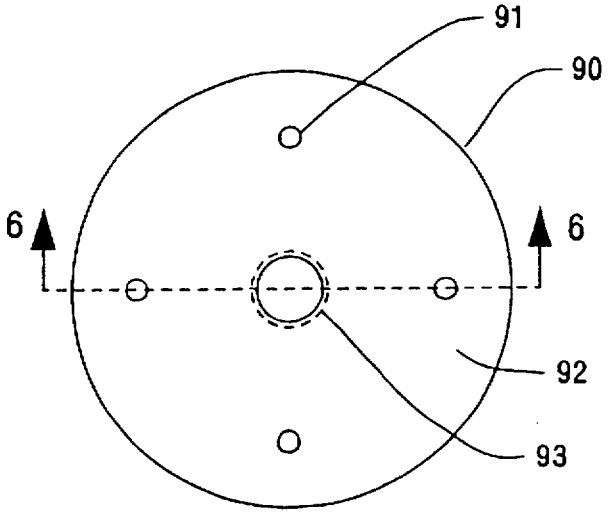
FIG. 5 is a view of a top plate to be used in accordance with the present invention.
Figure 6:
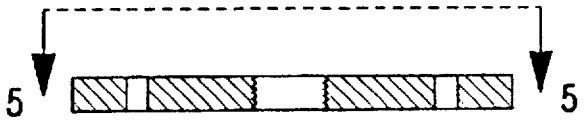
FIG. 6 is a view looking in the direction of the arrows along a line 6—6 in FIG. 5.
Figures 10, 11, 12, 13, 14, 15:
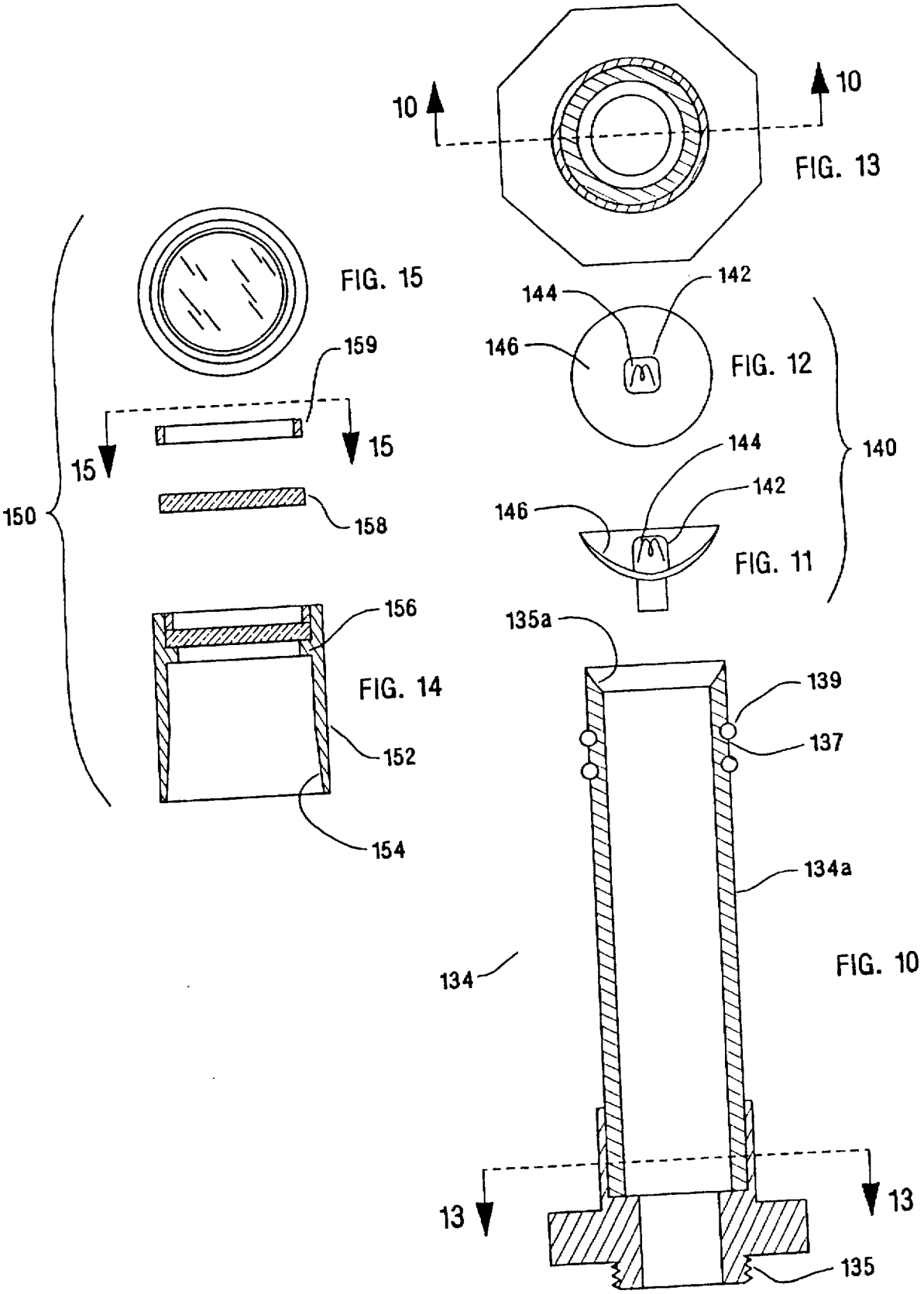
FIG. 10 is a view of a light source and focusing assembly to be utilized in accordance with the present invention.
FIG. 11 is a view illustrating a bulb and focusing assembly to be utilized in the present invention.
FIG. 12 is a plane view of FIG. 11 looking in the direction of the arrows along the line 12—12 in FIG. 11.
FIG. 13 is a plane view of FIG. 11 looking in the direction of the arrows along the line 13—13 in FIG. 12.
FIG. 14 is an exploded view of a lens mounting assembly to be utilized in the present invention.
FIG. 15 is a top view of the lens assembly to be utilized in the present invention.

As shown in FIG. 5, a removable cover plate 90 is provided including a body portion 92 and a plurality of spaced openings 108 to align with studs 107 located on partial top plate 128. Body portion 92 has a opening 93 to receive the orifice assembly 94.

The orifice assembly includes a threaded brass member 96 to engage threaded opening 93. Member 96 is hollow, and is connected, for example by silver soldering, to a stainless steel (18-8) washer 102 having a machined or otherwise formed knife edge 104. Laminar fluid flows outwardly through the opening 100.

A gasket 106 having openings 110 is located upon the plate 92. Mechanical fasteners or bolts 112 hold the assembly together.

In the bottom of the assembly a light source and focusing assembly 130 is provided including a bottom plate 132 having an opening 133 to receive a light mounting assembly 134 which is hollow and has a threaded end 135. See FIGS. 4 and 10–15.

Mounting member 134 includes a body portion 134*a* and one or a plurality of O-ring slots 137 to receive O-rings 139.

A light assembly 140 is located within mounting assembly 134 and includes a light housing 142 including a bulb 144 and a focusing light surface 146.

A cap assembly 150 includes a hollow cap body portion 152 having a lower tapered portion 154 to facilitate movement over O-rings 130. This assembly includes an inwardly directed projection 156 to receive a lens 158 and a retainer ring 159.

The surface of mounting member 134 is tapered at 135*a* to receive the cooperating tapered surface 146 of light housing 142.

The cap assembly 150 is then applied with the taper 154 facilitating insertion over the O-rings 139.

This assembly 134, 140 and 150 extends upwardly from bottom plate 132 through diffuser 82 and is terminated in the arcuate portion 84 of the diffuser 82.

Fluid thus flows inwardly through inlet 76 and then tangentially through the action of baffle 122 down and around the outer wall 72, tangentially inward under the opening 78 and then upwardly into diffuser 82. Fluid then flows upwardly through diffuser 82 to arcuate surface 84. The fluid flows into orifice assembly 94 and a knife-edged orifice 102 forms laminar flow which exits upwardly and out of the assembly.

Light is generated through bulb 144 and is focused through surface 146 and an appropriate lens 158 is provided for further focussing.

Figure 16:
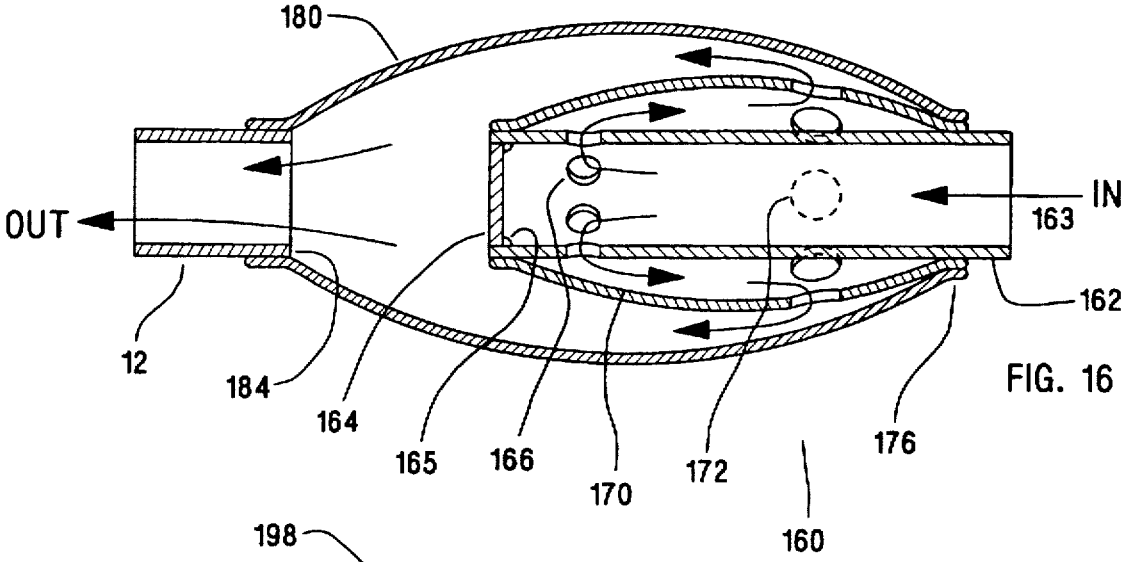
FIG. 16 is a schematic view of one embodiment of the flexible inlet assembly to be utilized in accordance with the present invention.

In accordance with another embodiment of the present invention illustrated in FIG. 16, an improved inlet assembly 160 is provided over that described in U.S. Pat. No. 5,160,086 at 34. The inlet assembly 160 includes an inlet conduit 162 having an opening 163 to receive fluid from a source (not shown). At the inner end of the conduit 162 a block off plate 164 is provided connected to the conduit 162 by welding indicated at 165 or mechanical fasteners.

A plurality of openings 166 are provided about the circumference of conduit 162 through which the fluid flows and into a bladder indicated generally at 170. Bladder 170 is made of flexible impervious material. The fluid flows in an opposite direction to the initial flow through conduit 162 until it reaches openings 172 in bladder 170. The bladder 170 is rigidly connected to the conduit 162 with adhesive as indicated at 176.

Fluid then flows outwardly through the openings 172 and into another flexible conduit or bladder made of impervious material indicated at 180. Fluid then flows again through bladder 180 in the same direction as within conduit 162. The fluid is then transferred to the inlet conduit 12. Conduit 180 is connected to the rigid inlet conduit 12 at 184.

Figure 17:
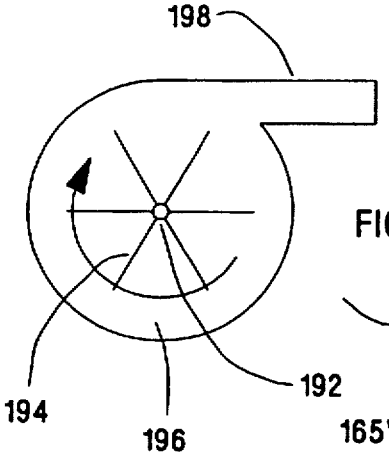
FIG. 17 is a schematic illustration of a cylindrical pump utilized to apply pulses to fluid flowing into a supply pipe.

As indicated in FIG. 17, a centrifical fluid pump 190 includes a shaft 192 having a plurality of outwardly extending veins 194, for example, six, which rotate within a chamber 196 and discharge fluid outwardly through a pipe 198.

Assuming that the shaft 192 rotates 1,720 rpm and with six veins operating, 10,320 pulses are exerted per minute. It is these pulses that it is desirable to eliminate or minimize. The pulses are a part of the fluid flow within conduit 162. Similar pulses are contained in the conduit 180.

In accordance with the present invention, it has been found that with this parallel, opposite direction flow, these pulses substantially cancel, to reduce or eliminate these pulses in the parallel flow embodiment as illustrated in FIG. 16.

Figure 18:
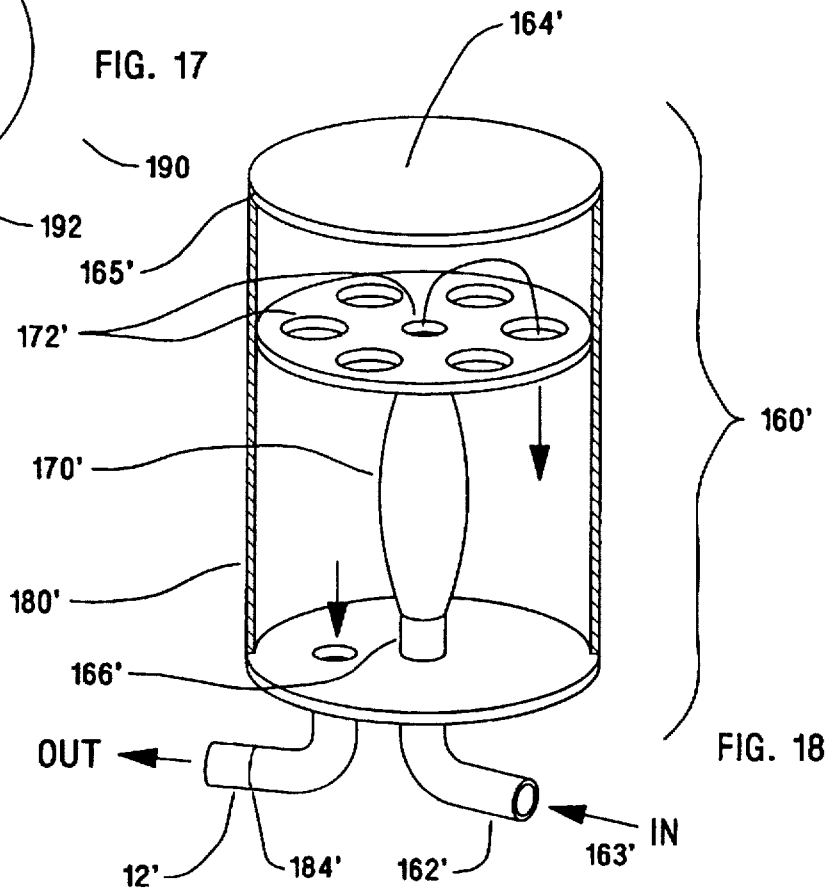
FIG. 18 is a view of another embodiment of the dampening assembly of the present invention.

FIG. 18 is an embodiment similar to FIG. 16 wherein an inlet conduit 162' allows fluid to flow therethrough. The end is blocked off at 164' by a closure plate which is connected by welding or other means at 165'.

Fluid flows outwardly through openings 166' inside a flexible conduit 170' in a different direction to fluid flow conduit 162' and then outwardly through openings 172' to an outside container 180', which in this embodiment is rigid.

The amount of reduction of pulses is somewhat less in the embodiment shown in FIG. 18, but it is more economical involving less flexible tubing and is more rugged in construction having a rigid outwall 180'.

The most improvement occurs in the embodiment shown in FIG. 16 wherein the other wall 180 is flexible and there is more opportunity for cancellation of pulses as fluid flows within the flexible conduit 170 and the flexible conduit 180.

What is claimed is:

1. A pressure pulse reducing assembly comprising:

a conduit adopted to receive fluid from a source of fluid;

means blocking off an end of said conduit;

a plurality of first openings provided in said pipe adjacent said block-off means;

a first flexible tube connected to said conduit adjacent said block-off means and adjacent said openings; whereby fluid may flow through said openings and flow in an opposite direction through said flexible member than through said conduit;

second fastening means holding said first flexible tube in engagement with said conduit downstream of said block off means;

and a second flexible tube in engagement with said first flexible tube;

second openings in said first flexible tube adjacent said second fastening means;

and third openings provided in said second flexible tube to allow fluid to flow outwardly within said second flexible tube outward of said first flexible member; and third fastening means connecting said second flexible member outboard of said block-off means to a rigid inlet means, whereby fluid may flow inwardly through said conduit to said first openings, then flow in a parallel but opposite direction along said conduit to said second openings; through said second openings along said second flexible tube in a parallel relationship, but in said rigid opposite direction to flow through said first flexible tube, and then into an inlet means whereby as fluid flows in opposite directions within said first and second flexible tube, pulses generated by compressor means may be reduced or eliminated.

2. A pressure pulse reducing assembly comprising:

a first flexible conduit having a first end having a first opening adopted to receive fluid from a source of fluid;

means for blocking off fluid flow adjacent a second end of said first conduit;

at least one second opening provided in said first conduit adjacent said means for blocking off fluid;

a second rigid conduit surrounding and completely enclosing said first conduit;

said second rigid conduit connected to said means for blocking off fluid adjacent said second end;

said second conduit having a first end having a third opening in fluid communication with said at least one second opening, and a second end having a fourth opening in fluid communication with outlet conduit means from said assembly adjacent said first opening whereby fluid may flow through said first opening and flow in said first conduit and out said second opening and then into said third opening in said second conduit an flow in a parallel but opposite direction to flow in said first conduit, out said fourth opening and then into said outlet conduit means whereby pressure pulses in said fluid may be reduced or eliminated by such flow.

3. An assembly according to claim 2 wherein said block off means comprise a transverse member extending across said second conduit.

4. An assembly according to claim 2 wherein said block off means comprise a first transverse member extending across said second conduit, and said assembly further includes second transverse member laterally spaced inwardly from said first transverse member and said second transverse member includes said second opening in said first conduit and said third opening in said second conduit.

* * * * *